US005257678A

United States Patent [19]

Stokes

[11] Patent Number: 5,257,678

[45] Date of Patent: Nov. 2, 1993

[54] OIL DRAIN SYSTEM FOR INTERNAL COMBUSTION ENGINES

[76] Inventor: Melvin Stokes, 617 Florida St., Clarksdale, Miss. 38614

[21] Appl. No.: 982,451

[22] Filed: Nov. 27, 1992

[51] Int. Cl.[5] ..... F16C 3/14

[52] U.S. Cl. ..... 184/1.5; 184/94; 184/106

[58] Field of Search ..... 184/1.5, 94, 106; 123/196 R

[56] References Cited

U.S. PATENT DOCUMENTS

| | | | |
|---|---|---|---|
| 1,557,390 | 10/1925 | Tolk et al. | 184/106 |
| 3,447,636 | 6/1969 | Bonfilio | 123/196 R |
| 3,954,250 | 5/1976 | Grace | 251/144 |
| 4,086,981 | 5/1978 | Mitsui | 184/1.5 |
| 4,299,307 | 11/1981 | Scott | 184/103 R |
| 4,319,664 | 3/1982 | Price et al. | 184/1.5 |
| 4,480,718 | 11/1984 | Marinelli | 184/103 R |
| 4,674,456 | 6/1987 | Merritt | 184/1.5 |
| 5,056,622 | 10/1991 | Vermeulen | 184/6.4 |
| 5,074,379 | 12/1991 | Batrice | 184/1.5 |
| 5,092,429 | 3/1992 | Linares et al. | 184/1.5 |

*Primary Examiner*—Thomas E. Denion

*Attorney, Agent, or Firm*—Walker, McKenzie & Walker

[57] ABSTRACT

A used oil drain system including a valve for being attached to the oil sump of an internal combustion engine; a used oil reservoir for being mounted relative to the internal combustion engine; and a passageway extending between the valve and the used oil reservoir for allowing used oil passing through the valve from the oil sump of the internal combustion engine when the valve is opened to pass to the used oil reservoir for storage. The valve may be screwed to the existing used oil drain port of the sump. The used oil reservoir may include a rigid container that is removably attached relative to the internal combustion engine.

5 Claims, 3 Drawing Sheets

OIL DRAIN SYSTEM FOR INTERNAL COMBUSTION ENGINES

BACKGROUND OF THE INVENTION

1. Field of the Invention

The present invention relates, in general, to an improved system for draining oil from internal combustion engines.

2. Description of the Related Art

It is extremely important to periodically change the oil in an internal combustion engine, both from a maintenance viewpoint of extending the life of the engine and from an ecological viewpoint of enhancing the performance of the engine. However, while adding oil to an internal combustion engine of a typical automobile or truck can normally be done fairly easily by merely opening the hood that covers the top of the engine, removing the cap that covers the oil fill tube, and pouring fresh oil from cans or the like into the oil fill tube, the drainage of used oil from the engine is typically difficult and time consuming. More specifically, most automobiles and trucks require a person to crawl or reach underneath the automobile or truck to remove the drain plug for removing used oil from the engine thereof. In addition, to prevent spillage of the used oil, a used oil receptacle must be placed under the drain port at the exact moment the drain plug is removed therefrom. This is further complicated by the fact that the used oil should be hot when it is drained from the engine. After the used oil is drained from the engine, a person must then crawl or reach back underneath the automobile or truck to replace the drain plug. Finally, the used oil must be disposed of in a legal, safe manner.

A preliminary patentability search has been conducted in class 184, subclass 1.5.

Grace, U.S. Pat. No. 3,954,250, issued May 4, 1976, discloses a two position drain valve or cock installed permanently in the threaded drain plug opening of an automotive crankcase. The drain valve or cock is operated by a crank arm arranged exteriorly of the valve casing on a valve actuating rotary shaft. The crank arm is shifted between opened and closed positions by a push-pull cable assembly including a manual lever pivoted to a mounting bracket installed under the hood of the automobile at a conveniently accessible location.

Mitsui, U.S. Pat. No. 4,086,981, issued May 2, 1978, discloses a drain device for removing or draining oil from oil pans used on engines of automobiles and similar vehicles. The drain device is mounted in the oil drain outlet of the oil pan and includes a valve which, when opened, permits the oil in the oil pan to drain from the oil pan and which, when closed, prevents the draining of oil from the oil pan. The valve is actuated by a handle or knob which is mounted on the dashboard of the automobile or vehicle.

Scott, U.S. Pat. No. 4,299,307, issued Nov. 10, 1981, discloses an oil level indicating and refilling device which includes a tube for being inserted to a predetermined depth into the dip stick orifice of an internal combustion engine, and connected to a small pump to initiate oil circulation in a line between the dip stick orifice and the tube. A pressure sensitive switch is inserted in this line and held in a normally open position while sufficient pressure is being sensed. When the oil level of the engine falls below the tube, the oil pressure sensed by the pressure sensitive switch drops and the switch closes, activating an indicator light disposed on the instrument panel of the vehicle. A oil reservoir is positioned above the engine and connected to the tube. A valve is disposed between the reservoir and the tube, and can be operated by remote control from inside the vehicle. When the indicator light is activated, the vehicle operator can actuate the valve to allow oil to flow into the engine from the reservoir.

Price et al., U.S. Pat. No. 4,319,664, issued Mar. 16, 1982, discloses a remotely controlled oil drain valve for being installed in the threaded drain plug opening of an automotive crankcase to permit drainage of crankcase oil without removal of the crankcase plug. The valve includes a valve core, a control arm attached to the valve core for moving the valve core between opened and closed positions, and a cable control mechanism having one end attached to the control arm and having a handle attached to the other end and mounted remote from the drain plug opening.

Marinelli, U.S. Pat. No. 4,480,718, issued Nov. 6, 1984, discloses a gravity induced lubricating oil level regulator system for use with an internal engine having a dipstick tube and an oil sump. The oil level regulator system includes an air-sealed lubricating oil reservoir adapted to be disposed above the level of the oil in the oil sump, and at least two elongated sloping tubes having their upper ends attached to the oil reservoir and their lower ends extended through the dipstick tube into the oil sump. The lower ends of the two sloping tubes are disposed at the functional oil level, and means is proved for sealing the elongated sloping tubes in the dipstick tube.

Vermeulen, U.S. Pat. No. 5,056,622, issued Oct. 15, 1991, discloses an oil level regulator for an internal combustion engine having an oil sump and a starter motor. A tank for topping-up oil is connected to the sump by a controllable shut-off device. A level measuring device measures the level of oil in the sump. If the oil level in the sump is adequate, the regulator allows the starter motor to be activated in the normal manner to start the engine. However, if the oil level in the sump is too low, the regulator prevents the starter motor from being activated and opens the shut-off device to allow oil to flow from the tank to the sump. When the oil level has risen to an adequate level, the regulator then closes the shut-off device and allows the starter motor to be activated.

None of the above identified patents or prior art discloses or suggests the present invention. More specifically, none of the above identified patents or prior art discloses or suggests a used oil drain system including, in general, valve means for being attached to the oil sump of an internal combustion engine; the valve means including a valve member having an opened position for allowing used oil to pass through the valve means from the oil sump of the internal combustion engine and having a closed position for preventing used oil from passing through the valve means from the oil sump of the internal combustion engine; used oil reservoir means for being mounted relative to the internal combustion engine; and passageway mean extending between the valve means and the used oil reservoir means for allowing used oil passing through the valve means from the oil sump of the internal combustion engine when the valve member is in the opened position to pass to the used oil reservoir means for storage.

SUMMARY OF THE INVENTION

The present invention is directed toward providing an improved system for draining used oil from an internal combustion engine. The concept of the present invention is to provide a remote-controlled valve means for allowing used oil to be drained from the sump of an internal combustion engine, and providing a used oil reservoir for catching the used oil so drained from the engine.

The used oil drain system of the present invention includes, in general, valve means for being attached to the oil sump of an internal combustion engine; the valve means including a valve member having an opened position for allowing used oil to pass through the valve means from the oil sump of the internal combustion engine and having a closed position for preventing used oil from passing through the valve means from the oil sump of the internal combustion engine; used oil reservoir means for being mounted relative to the internal combustion engine; and passageway means extending between the valve means and the used oil reservoir means for allowing used oil passing through the valve means from the oil sump of the internal combustion engine when the valve member is in the opened position to pass to the used oil reservoir means for storage.

DESCRIPTION OF THE PREFERRED EMBODIMENT

Figure 1:
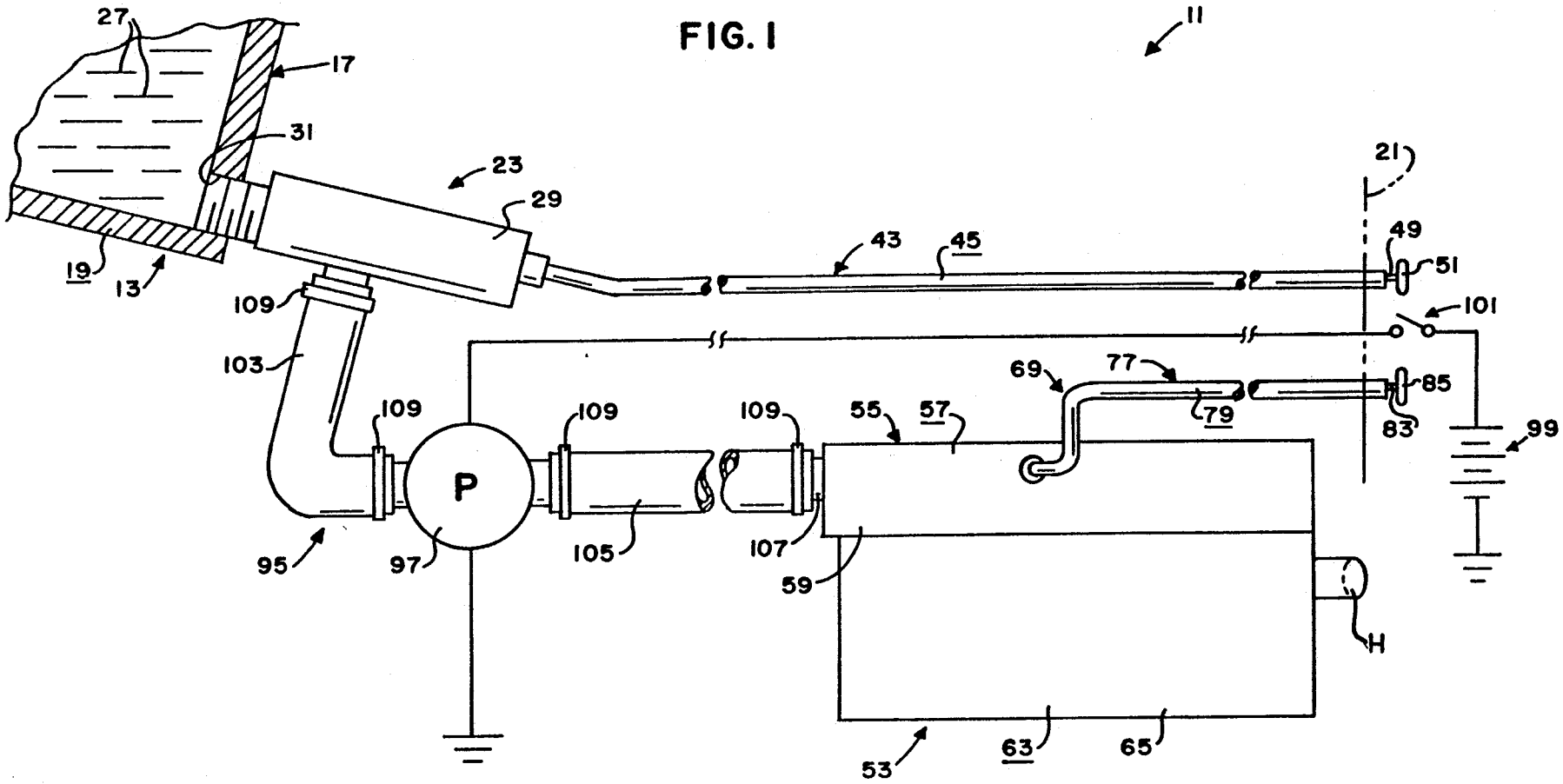
FIG. 1 is a diagrammatic elevational view of the oil drain system for internal combustion engines of the present invention, shown in combination with a portion of an internal combustion engine and an automobile.

The preferred embodiment of the used oil drain system of the present invention is shown in FIGS. 1-9 and identified by the numeral 11.

The system 11 is designed specifically for use in combination with a vehicle 13 such as an automobile, truck, tractor, etc., having a chassis 15, having an internal combustion engine 17 with an oil sump 19, and having an interior 21 with a seat (not shown) for the driver thereof.

Figure 2:
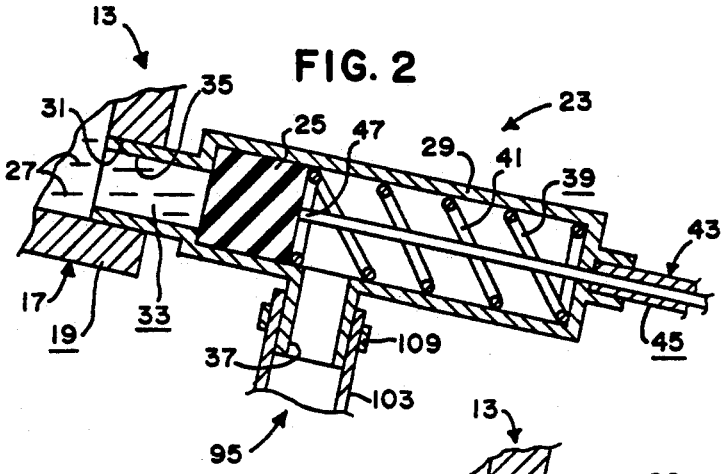
FIG. 2 is an enlarged sectional view of a portion of the oil drain system of FIG. 1, showing the valve means of the oil drain system of the present invention in a closed position.
Figure 3:
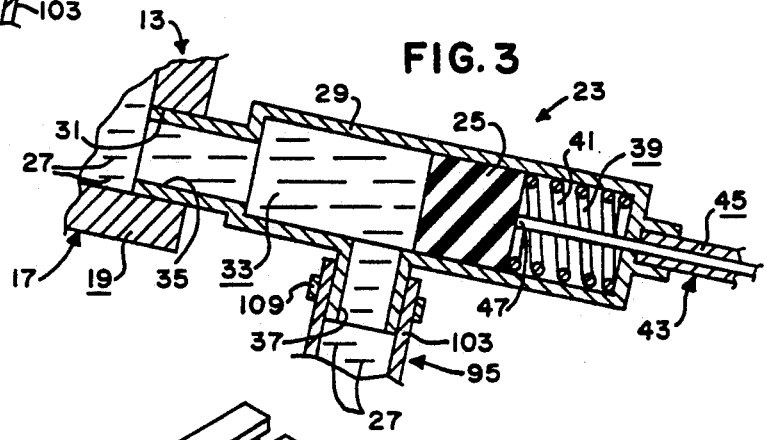
FIG. 3 is an enlarged sectional view similar to FIG. 1 but with the valve means in an opened position.
Figure 4:
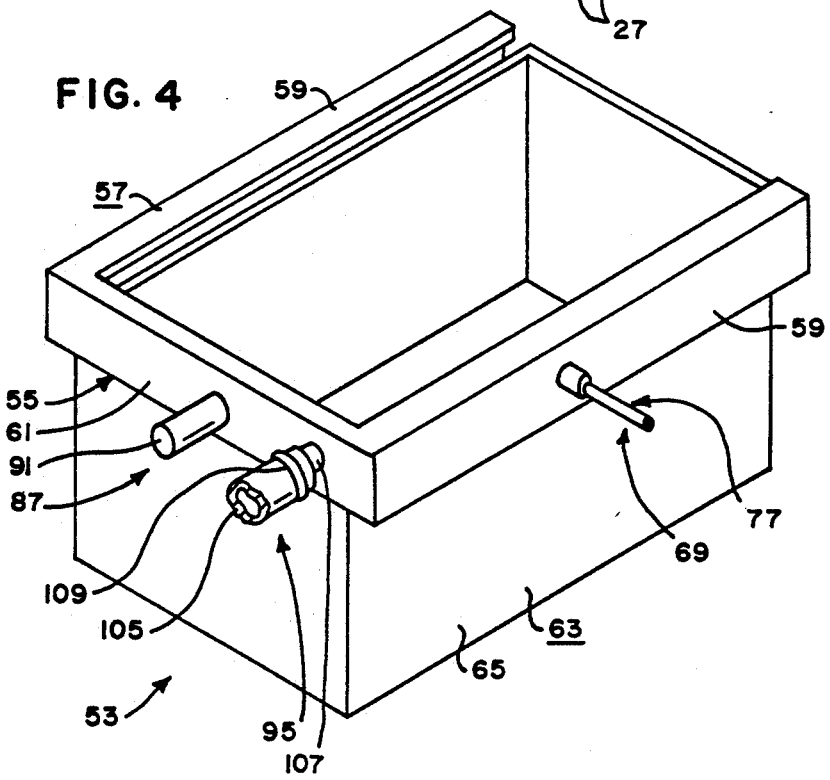
FIG. 4 is a perspective view of a portion of the oil drain system of the present invention, showing the used oil reservoir of the oil drain system of the present invention.
Figure 5:
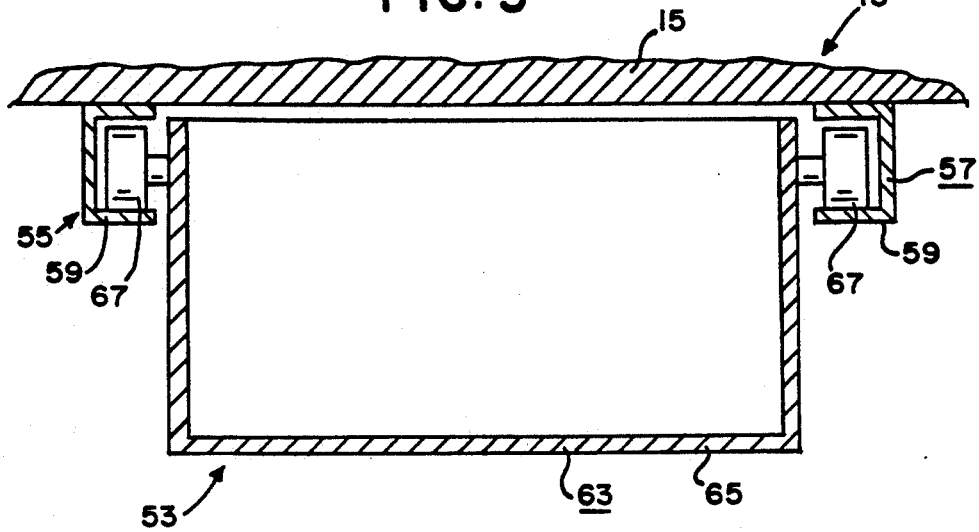
FIG. 5 is a sectional view of the used oil reservoir of FIG. 4 with the used oil reservoir shown attached to an automobile.

The system 11 includes a valve means 23 for being attached to the oil sump 19 of the internal combustion engine 17. The valve means 23 includes a valve member 25 having an opened position as shown in FIG. 3 for allowing used oil 27 to pass through the valve means 23 from the oil sump 19 having a closed position as shown in FIG. 2 for preventing used oil 27 from passing through the valve means 23 from the oil sump 19. More specifically, the valve means 23 preferably includes a valve body 29 for being screwed or otherwise secured to the typical internally threaded used oil outlet port 31 of the oil sump 19. The valve body 29 preferably has a passageway 33 therethrough with an inlet end 35 and an outlet end 37. The valve body 29 is preferably attached to the oil sump 19 with the inlet end 35 communicating with the used oil outlet port 31 of the oil sump 19 so that used oil 27 can pass from the oil sump 19, into the inlet end 35 of the passageway 33, and out the outlet end 37 when the valve member 25 is in the opened position.

The valve means 23 preferably includes urging means 39 for urging the valve member 25 thereof to the closed position shown in FIG. 2. The urging means 39 may consist simply of a typical coil spring 41 located within the valve body 29 for normally forcing the valve member 25 to the closed position a shown in FIG. 2.

The valve means 23 preferably includes remote control means 43 coupled relative to the valve member 25 for allowing the valve member 25 to be moved between the opened and closed positions from a location remote from the used oil outlet port 31 of the oil sump 19. The remote control means 43 preferably includes cable means 45 having a first end 47 for being attached to the valve member 25, and having a second end 49 for preferably being positioned within the interior 21 of the vehicle 13 for overcoming the force of the coil spring 41 and causing the valve member 25 to move to the opened position when the second end 49 thereof is pulled. A handle 51 or the like is preferably attached to the second end 49 of the cable means 45 for allowing the operator of the vehicle 13 or the like to easily pull the second end 49 and, thereby, cause the valve member 25 to move to the opened position as will now be apparent to those skilled in the art. The valve means 23 may be constructed in various manners and out of various materials as will now be apparent to those skilled in the art. Thus, for example, the valve body 29 may be machined or otherwise formed out of metal or the like, the valve member 25 may be cut or otherwise formed out of rubber or the like, the coil spring 41 may be a typical, off-the-shelf spring, and the cable means 45 may be a typical, off-the-shelf twisted wire cable slidably mounted within a sheath, etc., as will now be apparent to those skilled in the art. In addition, it should be noted that a valve means that can be used as the valve means 23 is described in Grace, U.S. Pat. No. 3,954,250, issued May 4, 1976, incorporated herein by reference.

The used oil drain system 11 includes a used oil reservoir means 53 for being mounted relative to the internal combustion engine 17. The used oil reservoir means 53 preferably includes a carriage means 55 for being fixedly mounted to the chassis 15, etc., of the vehicle 13. The carriage means 55 may consist of a generally U-shaped frame 57 for being bolted or otherwise secured to the chassis 15 of the vehicle 13. The frame 57 preferably includes a pair of spaced apart channel members 59 joined together at one end by a cross member 61. Each channel member 59 is preferably substantially C-shaped in cross section as clearly shown in FIGS. 5–7 for reasons which will hereinafter become apparent. The used oil reservoir means 53 preferably includes a used oil container means 63 for receiving used oil 27 from the valve means 23 and for being removably attached to the carriage means 55. Thus, the used oil container means 63 has a first position attached to the carriage means 55 (see, in general, FIG. 8) and a second position detached from the carriage means 55 (see, in general, FIG. 9). The used oil container means 63 may consist of an opened-top pan 65 or the like for storing used oil 27 for a period of time. Wheel members 67 may be attached to opposite sides of the pan 65 for engaging the channel members 59 as clearly shown in FIG. 5 to rollably attach the pan 65 to the frame 57 as will now be apparent to those skilled in the art. The frame 57 may be secured to the chassis 15 in a location and position which allows the user of the used oil drain system 11 to easily slide or otherwise remove the pan 65 therefrom from a position beside the vehicle 13, etc. The pan 65 may include a handle H on the front thereof (see FIG. 1) to allow the user of the used oil drain system 11 to easily pull the pan 65 from the frame 57.

Alternatively, the used oil container means 63 may consist of a substantially closed container (not shown) having a single aperture for receiving used oil 27 from the valve means 27 and for allowing used oil 27 to be subsequently poured therefrom into a used oil collection port or the like.

The used oil reservoir means 53 preferably includes lock means 69 for locking the used oil container means 63 to the carriage means 55. The lock means 69 preferably includes a lock member 71 having a locked position a shown in FIG. 6 for locking the used oil container means 63 in the first position and having an unlocked position as shown in FIG. 7 for allowing the used oil container means 63 to move to the second position. Thus, the lock member 71 may consist of a pin-like member for extending into an aperture 72 in the upper edge of one side of the pan 65 of the used oil container means 63 when in the locked position.

Figure 6:
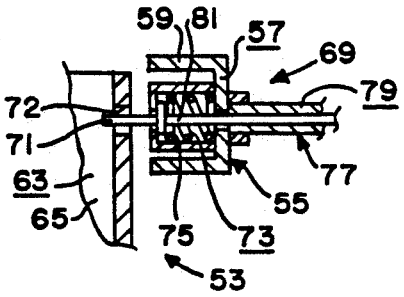
FIG. 6 is a sectional view of a portion of the used oil reservoir of FIG. 5 showing the lock means thereof in a locked position.
Figure 7:
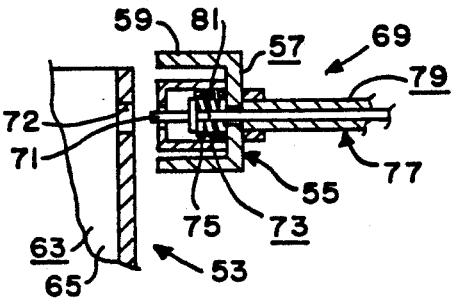
FIG. 7 is a sectional view similar to FIG. 6 but showing the lock means thereof in an unlocked position.

The lock means 69 preferably includes urging means 73 for urging the lock member 71 thereof to the looked position shown in FIG. 6. The urging means 73 may consist simply of a typical coil spring 75 mounted to the frame 57 of the carriage means 55 in such a manner so as to normally urge the lock member 71 to the locked position.

The lock means 69 preferably includes remote control means 77 coupled relative to the lock member 71 thereof for allowing the lock member 71 to be moved to the unlocked position from a location remote from the carriage means 55. The remote control means 77 preferably includes cable means 79 having a first end 81 for being attached to the lock member 71, and having a second end 83 for preferably being positioned within the interior 21 of the vehicle 13 for overcoming the force of the coil spring 75 and causing the lock member 71 to move to the unlocked position when the second end 83 thereof is pulled. A handle 85 or the like is preferably attached to the second end 83 of the cable means 81 for allowing the operator of the vehicle 13 or the like to easily pull the second end 83 and, thereby, cause the lock member 71 to move to the unlocked position as will now be apparent to those skilled in the art.

The lock means 69 may be constructed in various manners and out of various materials as will now be apparent to those skilled in the art. Thus, for example, the lock member 71 may be machined or otherwise formed out of substantially rigid metal, the coil spring 75 may be a typical, off-the-shelf spring, and the cable means 79 may be a typical, off-the-shelf twisted wire cable slidably mounted within a sheath, etc., as will now be apparent to those skilled in the art.

Figure 8:
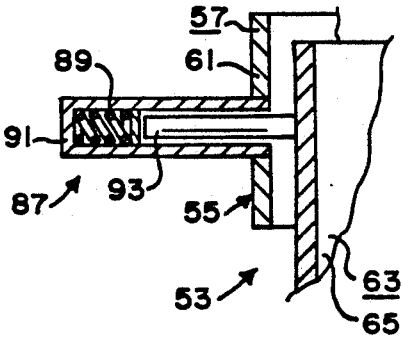
FIG. 8 is a sectional view of a portion of the used oil reservoir of the oil drain system of the present invention, showing the urging means thereof in a first position.
Figure 9:
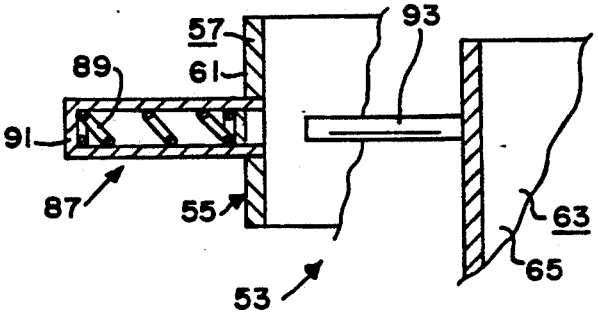
FIG. 9 is a sectional view of a portion of the used oil reservoir of the oil drain system of the present invention similar to FIG. 8, but showing the urging means thereof in a second position.

The used oil reservoir means 53 preferably includes urging means 87 for urging the pan 65 of the used oil container means 63 to the second position when the lock member 71 of the lock means 69 is moved to the unlocked position. The urging means 87 may include a typical coil spring 89 positioned within a tube 91 or the like on the cross member 61 of the frame 57 of the carriage means 55, and a projecting finger 93 mounted on the pan 65 of the used oil container means 63 for extending into the tube 91 and for compressing the coil spring 89 when the pan 65 of the used oil container means 63 is moved to the first position as shown in FIG. 8. As will now be apparent to those skilled in the art, when the lock member 71 is moved to the unlocked position, the coil spring 89 will force the finger 93 out of the tube 91 and will, therefore, force the pan 65 of the used oil container means 63 to the second position.

The used oil drain system 11 includes passageway means 95 extending between the valve means 23 and the used oil reservoir means 53 for allowing used oil 27 passing through the valve means 23 from the oil sump 19 of the internal combustion engine 17 when the valve member 23 is in the opened position to pass to the used oil reservoir means 53 for storage.

The passageway means 95 preferably includes a pump means 97 for pumping used oil 27 from the oil sump 19, through the valve means 23, and to the used oil reservoir means 53 for storage when the valve member 23 of the valve means 23 is in the opened position. The pump means 97 preferably consists of a typical, off-the-shelf electric oil pump or the like for being electrically coupled to the battery 99 of the vehicle 13, or other convenient source of electrical energy, for being electrically energized by the operator of the vehicle 13 or the like when the remote control means 43 is activated to move the valve member 25 to the opened position. An electric switch 101 is preferably electrically coupled to the battery 99 and pump means 97 for allowing the operator of the vehicle 13 or the like to easily electrically energize the pump means 97. The switch 101 is preferably positioned within the interior 21 of the vehicle 13 and may be coupled to the remote control means 43 to close when the handle 51 is pulled to move the valve member 25 to the opened position so that the operator of the vehicle 13 or the like can simultaneously open the valve member 25 and activate the pump means 97 as will now be apparent to those skilled in the art.

The passageway means 95 preferably includes a first hose 103 for extending between the outlet end 37 of the passageway 33 through the valve body 29 and the inlet of the pump means 97, and a second hose 105 for extending between the outlet of the pump means 97 and the used oil reservoir means 53. The carriage means 55 of the used oil reservoir means 53 preferably has a port 107 mounted on the cross member 61 thereof for communicating with the interior of the pan 65 of the used oil container means 63 when the pan 65 of the used oil container means 63 is in the first position, and the second hose 105 is attached to this port 107 so that used oil 27 pumped through the hose 105 will pass into the interior of the pan 65 as will now be apparent to those skilled in the art. The hoses 103, 105 may be typical oil-resistant rubber hoses or the like securely attached to the respective components by typical radiator clamps 109 or the like as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A used oil drain system for internal combustion engines having an oil sump, said oil drain system comprising:

a) valve means for attachment to the oil sump of the internal combustion engine; said valve means including a valve member having an opened position for allowing used oil to pass through said valve means from the oil sump of the internal combustion engine and having a closed position for preventing used oil from passing through said valve means from the oil sump of the internal combustion engine;

b) used oil reservoir means for mounting to the internal combustion engine; and c) passageway means extending between said valve means and said used oil reservoir means for allowing used oil passing through said valve means from the oil sump of the internal combustion engine when said valve member is in said opened position to pass to said used oil reservoir means for storage;

said used oil reservoir means including carriage means for fixedly mounting to the internal combustion engine; said used oil reservoir means including used oil container means for receiving used oil from said passageway means and for being removably attached to said carriage means, said used oil container means having a first position attached to said carriage means and a second position detached from said carriage means; said used oil reservoir means including lock means for locking said used oil container means to said carriage means, said lock means including a lock member having a locked position for locking said used oil container means in said first position and having an unlocked position for allowing said used oil container means to move to said second position; said used oil reservoir means including remote control means coupled to said lock member of said lock means for allowing said lock member to be moved to said unlocked position from a location remote from said carriage means.

2. The used oil drain system of claim 1 in which said remote control means of said used oil reservoir means includes cable means having first and second ends for moving said lock member of said lock means to said unlocked position when said second end thereof is pulled, said first end of said cable means being attached to said lock member, said second end of said cable means being positioned at a location remote from said carriage means.

3. The used oil drain system of claim 2 in which said lock means includes urging means for urging said lock member thereof to said locked position.

4. The used oil drain system of claim 1 in which said used oil reservoir means includes urging means for urging said used oil container means to said second position when said lock member of said lock means is moved to said unlocked position.

5. A used oil drain system for use in combination with a vehicle having a chassis, having an internal combustion engine with an oil sump, and having an interior with a seat for the driver thereof; said oil drain system comprising:

a) valve means for attachment to said oil sump of said internal combustion engine; said valve means including a valve member having an opened position for allowing used oil to pass through said valve means from said oil sump of said internal combustion engine and having a closed position for preventing used oil from passing through said valve means from said oil sump of said internal combustion engine; said valve means including remote control means coupled to said valve member for allowing said valve member to be moved between said opened and closed positions from a location within said interior of said vehicle; said remote control means including cable means having first and second ends for moving said valve member to said opened position when said second end thereof is pulled, said first end of said cable means being attached to said valve member, said second end of said cable means being positioned within said interior of said vehicle; said valve means includes urging means for urging said valve member thereof to said closed position;

b) used oil reservoir means for mounting to said internal combustion engine; said used oil reservoir means including carriage means for fixedly mounting to said chassis of said vehicle; said used oil reservoir means including used oil container means for receiving the used oil from said valve means and for being removably attached to said carriage means, said used oil container means having a first position attached to said carriage means and a second position detached from said carriage means; said used oil reservoir means including lock means for locking said used oil container means to said carriage means, said lock means including a lock member having a locked position for locking said used oil container means in said first position and having an unlocked position for allowing said used oil container means to move to said second position; said used oil reservoir means including remote control means coupled to said lock member of said lock means for allowing said lock member to be moved to said unlocked position from a location within said interior of said vehicle; said remote control means including cable means having first and second ends for moving said lock member of said lock means to said unlocked position when said second end thereof is pulled, said first end of said cable means being attached to said lock member, said second end of said cable means being positioned within said interior of said vehicle; said lock means including urging means for urging said lock member thereof to said closed position; said used oil reservoir means including urging means for urging said used oil container means to said second position when said lock member of said lock means is moved to said unlocked position; and c) passageway means extending between said valve means and said used oil reservoir means for allowing the used oil passing through said valve means from said oil sump of said internal combustion engine when said valve member is in said opened position to pass to said used oil reservoir means for storage; said passageway means including pump means for pumping used oil from said oil sump of said internal combustion engine, through said valve means, and to said used oil reservoir means for storage when said valve member of said valve means is in said opened position.

* * * * *